United States Patent [19]

Neil

[11] Patent Number: 4,861,010

[45] Date of Patent: Aug. 29, 1989

[54] AFFIXATION OF VISE JAW REMOVABLE FACEPLATES BY KEYHOLE APERTURES

[76] Inventor: Michael A. Neil, c/o Quad-One Corporation, 14397 Janal Way, San Diego, Calif. 92129

[21] Appl. No.: 179,053

[22] Filed: Apr. 8, 1988

[51] Int. Cl.[4] ..... B25B 1/24

[52] U.S. Cl. ..... 269/282

[58] Field of Search ..... 269/279, 280, 282–284, 269/286; 81/422, 423, 424.5

[56] References Cited

U.S. PATENT DOCUMENTS

| | | | |
|---|---|---|---|
| 2,741,145 | 4/1956 | Bahorik | 269/282 |
| 3,565,417 | 2/1971 | Degle | 269/284 |
| 4,251,066 | 2/1981 | Bowling | 269/283 |
| 4,437,654 | 3/1984 | Chiappetti | 269/283 |
| 4,706,949 | 11/1987 | Dossey et al. | 269/283 |

FOREIGN PATENT DOCUMENTS

| | | | |
|---|---|---|---|
| 59161 | 12/1953 | France | 269/282 |
| 1237780 | 6/1960 | France | 269/282 |

*Primary Examiner*—Robert C. Watson

*Attorney, Agent, or Firm*—Dressler, Goldsmith

[57] ABSTRACT

Each jaw of a vise has fasteners, typically two allen-headed bolts, mounted at its face and protruding therefrom. Removable faceplates define keyhole apertures that are complementary in size and spacing to the allen-headed bolts. The faceplates' keyhole apertures slip over the loosened bolts without removing the bolts from the jaws. Each removable faceplate is then secured to its jaw by tightening the bolts against the shoulders of the keyhole aperture at its narrower regions. A removable faceplate so affixed is quickly interchangeable while maintaining good alignment and strength in its installed position.

15 Claims, 2 Drawing Sheets

AFFIXATION OF VISE JAW REMOVABLE FACEPLATES BY KEYHOLE APERTURES

BACKGROUND OF THE INVENTION

1. Field of the Invention

The present invention concerns the affixing of removable faceplates to the jaws of a machine vise by means of fasteners passing within keyhole apertures.

2. Background of the Invention

A vise is a common means of holding a workpiece during machine operations. The workpiece is placed between the open jaws of the vise and the jaws are then tightened, clamping the workpiece securely. The vise is sometimes positionally and/or rotatably adjustable in order to position the workpiece during machining operations. At the conclusion of machining operations the vise is opened and the processed workpiece extracted.

It is known to use removable faceplates on the jaws of machinist's vises in order to better support grasping and clamping the workpiece. The removable faceplates may be, for example, of a relatively softer metal material, for example aluminum, than the strong metal material, normally steel, from which the jaws are typically made. The removable faceplates may also present contours such as V-grooves, steps, and/or serrations which are particularly suitable to the grasping and holding of individual workpieces. Indeed, the contours of a removable faceplate may be made in a custom contour as besuits the effective contacting and holding of a particular workpiece or type of workpiece.

A vise jaw removable faceplate is positioned and secured to the operative side of a vise jaw that is adapted for fitting such a removable faceplate. The removable faceplate typically has equal width and depth to the normal jaw of the vise. The removable faceplate is typically of adequate thickness so as to permit it to be (i) securely affixated to the vise jaw and (ii) pressured into grasping contact with the workpiece without undue distortion. For example, for a typical vise jaw having a 6" width and a $1\frac{3}{4}$" depth, a removable jaw faceplate would typically be 6" wide by $1\frac{3}{4}$" depth by 13/16" thickness. Two such opposed removable faceplates reduce the maximum gap between the open vise jaws (for example, by twice 13/16", or 1 10/16") but this reduction is normally not a problem.

The present invention particularly concerns the manner by which removable faceplates may be fixed to the permanent jaws of a vise. One previous method of affixing removable faceplates to vise jaws is by machine bolts threading round holes within the removable faceplates. The diameter of the holes is typically countersunk to an adequate depth so as to permit the heads of the bolts to be recessed below the surface of the faceplate, making that the operative face of the faceplate presents a flat surface from which the bolt heads do not protrude.

One type of bolt that is typically used to affix removable faceplates is an allen-headed bolt having an internal hexagonal aperture that fits an allen wrench. The particular type of bolt is, however, important neither to the affixation of the previous removable faceplates nor to the removable faceplate of the present invention. It merely sufficient that the head of the bolt or other fastener should present a shoulder which fits against a corresponding lip of an aperture within the removable faceplate in order to secure the removable faceplate to the vise's jaw by tightening of the bolt.

A problem exists with the previous affixation of vise jaw removable faceplates to vise jaws by bolts passing through round apertures (which apertures may be countersunk). Mainly, each removal and substitution of the removable faceplate requires the complete extraction and reinsertion of the one or more securing bolts. Removable faceplates may be interchanged quite frequently during a machining operation. Faceplates are normally freely interchanged as best besuits the differing surfaces of the same or of different workpieces to be, at different times, held within the vise jaws. During each such interchange the securing bolts, typically two in number, to the removable faceplate must be completely unscrewed. A substitutionary removable faceplate is then positioned in place. The same bolts are rethreaded into the same holes and retightened.

Because the transverse forces that are transmitted to the removable faceplate during machining of a held workpiece may be very high, the bolts are typically substantial. The bolts are typically of $\frac{1}{2}$"-13 diameter for the previously-mentioned typical 6" width vise jaw. This $\frac{1}{2}$" bolt is also threaded into the permanent jaws for a considerable depth in order to provide adequate strength, typically for a depth of $\frac{1}{2}$ or greater. This means that each interchange of a previous vise jaw removable faceplate, of which there are typically two upon each vise, requires that two bolts should be (i) unthreaded over a distance of $\frac{1}{2}$, (ii) extracted from the round apertures of the vise jaw removable faceplate and temporarily stored, (iii) passed through the round apertures of the substitutionary vise jaw removable faceplate, (iv) rescrewed into the threaded holes of the vise jaw, and (vi) tightened. Although routinely performed, this procedure is time consuming and not as efficient as would be desired.

Meanwhile, it is generally known in the mechanical arts that bolted affixation of members may transpire by use of a keyhole aperture within one of the affixed members. A keyhole aperture is an elongate hole, or slot, which has a relatively greater diameter at one end of the hole, or slot, than at the other end. The smaller and larger diameters of the aperture are respectively complementary in size to the shank and head of a bolt which is received within such aperture. The head of the bolt, which is typically round, will pass through the larger diameter portion of the keyhole aperture but will not pass through the smaller diameter portion. The shank of the bolt will pass through both portions of the aperture.

The action of affixing members by passing bolts through keyhole apertures does not require that a bolt should be completely extracted from one member in order to fit and to attach another member that presents a keyhole aperture. Rather, the wider portion of the keyhole aperture within the one member passes the head of the bolt. This one member is then moved transversely so that the bolt head is within the narrow diameter region of the keyhole aperture. At this location the bolt is further tightened so as to contact the shoulders of the keyhole aperture at the region of its narrow diameter. By this tightening the two members are securely attached.

A keyhole aperture may be countersunk in order to permit the heads of the bolts which thread it to fit flush with, or below, the surface of the member presenting the keyhole aperture.

SUMMARY OF THE INVENTION

The present invention of a vise jaw removable faceplate affixation system is embodied in a vise affixing a removable faceplate to at least one of its jaws, in the removable faceplate so affixable to the vise's jaw, and in a method of affixing a removable faceplate to a vise's jaw.

A vise employing the removable faceplate affixation system in accordance with the present invention includes a frame and two opposed jaws. At least one of the jaws is slidable relative to the frame for selectively clamping a workpiece between the two jaws. A fastener is mounted at the face of at least one jaw and protrudes therefrom. Meanwhile, a removable faceplate to the at least one jaw defines at least one keyhole aperture.

In accordance with the present invention, the fastener upon the jaw's face affixes the removable faceplate by engaging its keyhole aperture. The affixation occurs by action of (i) slipping the wide portion of the keyhole aperture over a relatively wider head of the fastener, and then (ii) sliding this relatively wider fastener head over the relatively narrower region of the keyhole aperture, while (iii) passing the relatively narrower fastener shank through the relatively narrower region of the keyhole aperture. It is not necessary that the fastener should be completely removed from the jaw face from which it protrudes in order to affix the removable faceplate at the jaw face.

The removable faceplate's keyhole aperture may be either a hole of closed circumference or a slot of open circumference. The keyhole aperture is typically countersunk so that when the fastener's head is positioned over the narrow region of the keyhole aperture then the head is located at or below the surface of the faceplate that contacts the workpiece.

The fastener is typically a bolt, and is more typically an allen-headed bolt. It is typically mounted at and within the jaw's face by being screwed within a threaded hole. The fastener may alternatively be a stud within the face of the jaw. The stud may be threaded into the jaw or otherwise affixed, such as by welding. The stud threads a nut.

The face of each of the two vice jaws typically presents two fasteners. The removable faceplate defines two keyhole apertures that are of complementary size and spacing to the two fasteners.

The removable faceplate is selectively made of a suitably soft or resilient material for contacting the workpiece. It selectively exhibits a non-planar contour that is suitably complementary to the contour of the workpiece in order to better grasp and hold such workpiece. The removable faceplates' face contours may selectively be a grid, serrations, one or more V-grooves, or a custom contour suitable to a particular workpiece or workpiece type.

The removable faceplate itself may selectively mount still another, second, faceplate. In this case the removable faceplate is called a removable mount. It is the second faceplate mounted on the removable mount that ultimately contacts the workpiece grasped between vise's jaws. The second faceplate is typically mounted to the removable mount by interlocking dovetail grooves and clip plates. The second faceplate may alternatively be mounted to the removable mount by still another, successive, system of fasteners and keyhole apertures.

The vise jaw removable faceplate affixation system and method in accordance with the present invention is reliable, accurate, strong, and, most importantly, fast. A removable faceplate (or a removable mount) to a vise jaw may typically be interchanged in a small fraction of the time required for the interchange of previous vise jaw removable faceplates.

BRIEF DESCRIPTION OF THE DRAWINGS

FIG. 4 is an end view of the second embodiment of the removable faceplate shown in FIG. 4.

DESCRIPTION OF THE PREFERRED EMBODIMENT

Figure 1:
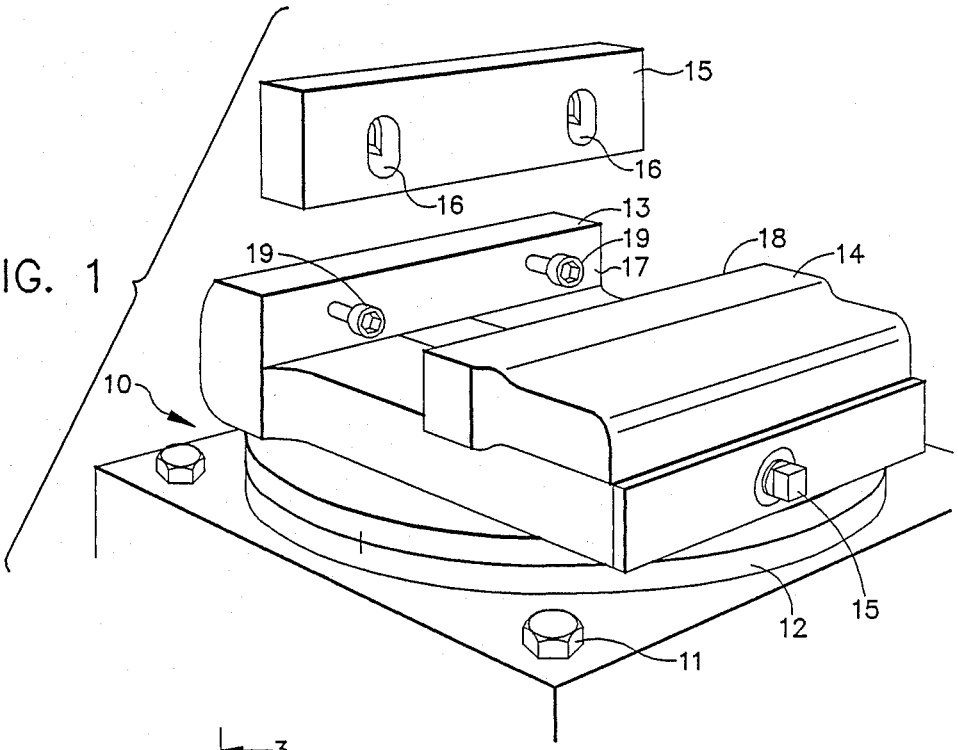
FIG. 1 is a perspective view showing the vise jaw removable faceplate affixation system in accordance with the present invention.

The affixation system of the present invention for removably affixing a faceplate to the face of one or more jaws of a vise is shown in FIG. 1. A vise 10 is mounted to the bed of machine tool (not shown) by fasteners such as bolts 11. The vise 10 may operationally employ a turret 12 in order to allow the opposed jaws 13, 14 to be rotated relative to the machine bed (not shown) and machine head (not shown) of the machine tool. Under the commonly understood principle of a vise, a turning of a vise screw (not shown) via its exposed head 15 moves the vise jaws 13, 14 to greater or lesser degrees of separation.

The jaws 13, 14 of vise 10 are generally hard steel. The jaws 13, 14 are generally permanent component parts of the vise 10. In order that wear to the facing surfaces of such jaws may be avoided, or in order that a contour and/or a material more suitable to a workpiece may be presetted, it is common to face one or both jaws 13, 14 with a removable faceplate 15.

In accordance with the present invention, the illustrated removable faceplate 15 defines one or more keyhole apertures 16. There are typically two such apertures 16 as illustrated in FIG. 1. Meanwhile, one or both of the faces 17, 18 to jaws 13, 14 mounts a corresponding number of fasteners 19. Two such fasteners 19 on face 17 to jaw 13 are shown in FIG. 1. The fastener 19 is typically a bolt, such as the illustrated allen-headed bolt. The fastener is typically screwed within a corresponding threaded hole at the faces 17, 18 of jaws 13, 14. The fastener 19 may alternatively be a stud (not shown) which is fixed within the faces 17, 18 of jaws 13, 14. The stud may be so fixed within the faces 17, 18 by being screwed into a threaded hole or by being permanently affixed, such as by welding. The stud may even be machined from the material of the jaw face. When a stud is used then the "head" of the fastener is a nut (not shown) which threads the stud.

Figure 2:
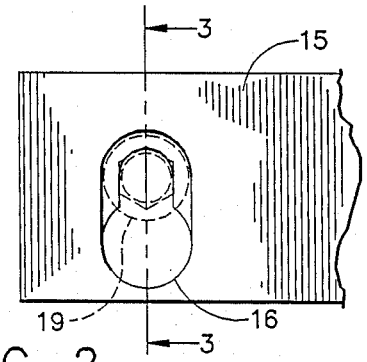
FIG. 2 is a front view showing a keyhole aperture within a first embodiment of a removable faceplate of the system of the present invention.
Figure 3:
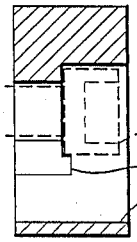
FIG. 3 is a side view, taken along aspect line 3—3 of FIG. 2, showing the keyhole aperture.

A particular construction of the keyhole aperture 16 of vise jaw removable faceplate 15 that is of complementary configuration to engage fasteners 19 upon faces 17, 18 to jaws 13, 14 is shown in detail in FIGS. 2 and 3. The keyhole aperture 16 shown therein is of closed circumference, being substantially oval in shape. The keyhole aperture 16 exhibits a first relatively wider portion (shown disposed toward the bottom of FIGS. 2 and 3) and a second relatively narrower portion (shown disposed toward the top of FIGS. 2 and 3).

The diameters of the head and shank regions of fasteners 19 (shown in dashed line in FIGS. 2 and 3) are respectively complementary to the relatively wider and to the relatively more narrow portions of the keyhole aperture 16. As is the well understood operation of a keyhole aperture, the head of fastener 19 may be passed through the relatively wider portion of the keyhole aperture 16 and, the fastener remaining connected (to faces 17, 18 of jaws 13, 14), the removable faceplate 15 may be slid transversely so that the fastener 16 assumes its illustrated position within the narrow region of keyhole aperture 16.

The keyhole aperture 16 is also preferably countersunk, as is best illustrated in FIG. 3, so as to allow the head of fastener 19 to be recessed completely below the operative surface of removable faceplate 15. The surface presented to the workpiece (not shown) by faceplate 15 is thus substantially planar.

The keyhole aperture is further preferably countersunk to two slightly different depths. Particularly, a small shoulder of metal 15-1 is typically machined within the countersunk keyhole aperture 16 within faceplate 15. This shoulder 15-1 surrounds the head of fastener 19. It prevents that the faceplate 15 should slide upwards on jaws 13, 14 of vise 10 when the fastener 19 is tightened. This feature improves the locked down stability of removable faceplate 1 during these occasional machining operations that exert an upwards force on faceplate 15 when it is mounted to faces 17, 18 of jaws 13, 14.

The alignment of the long axis of the keyhole aperture cannot be a matter of happenstance. The removable faceplate 15 typically affixes to faces 17, 18 of jaws 13, 14 so that one of its long edge surfaces is flush to the bed of the vise 10. Due deliberation will reveal that the motions needed to seat the removable faceplate's 15 keyhole apertures 16 in position about fasteners 19 preclude that the keyhole apertures should be reversed or that, equivalently, that the removable faceplate 15 should be installed upside down. The wide portion of the keyhole aperture 16 must be, for any alignment of the keyhole aperture transversely to the bed of the vise 10, positionally disposed directionally toward the bed of vise 10.

It is possible to fit a removable faceplate 15 to the faces 17, 18 of jaws 13, 14 of vise 10 if the keyhole apertures 16 were both, jointly, to have their long axis rotated either plus or minus 90° in the same sense. The removable faceplate 15 could then be affixed providing that there was adequate clearance to the sides of vise 10. The alignment of keyhole apertures 16 at alignments 90° from the alignment shown in FIGS. 1–7 is not, however, preferred. This is because the process of machining a workpiece (not shown) clamped within vise 10 against removable faceplate 15 typically induces longitudinal shear forces along the long axis of the removable faceplate 15. It is desired that these shear forces should be positively transmitted to fasteners 19, jaw faces 17, 18, jaws 13, 14 and to vise 10—even if fasteners 19 are not securely tightened. The illustrated alignment of keyhole apertures 16 permits both (i) affixing of the removable faceplate 15 and (ii) positive transmission of shear forces without depending upon secure tightening of fasteners 19. The illustrated alignment is preferred.

The preferred alignment of keyhole apertures 16 bestows an advantage over previous systems of affixing a removable faceplate to a vise jaw. The removable faceplate 15 can only be fitted to the faces 17, 18 of vise jaws 13, 14 in one front to back, left to right, top to bottom alignment. The removable faceplate 15 typically possesses contours upon its operative face for engaging the workpiece, as will be explained in conjunction with FIGS. 4–9. Sometimes these contours are subtle, and subtly different, from left to right or from top to bottom upon the operative face of removable faceplate 15. In other words, the faceplate's 15 face may be asymmetrical in either of two axis, and subtly so.

It is desired that the faceplate 15 should be correctly positioned to contact the workpiece. If it is not so positioned then the workpiece may be inadequately clamped resulting in poor workpiece alignment and/or undesired workpiece motion during machining operations. Certain relatively soft or frangible workpieces may even be damaged by an improperly installed removable faceplate. The affixation system in accordance with the present invention ensures precise and correct orientation and alignment of removable faceplates.

The removable faceplate 15 may be selectively made out of materials which differ in hardness and resiliency from the material of jaws 13, 14. For example, the removable faceplate 15 may be made from hard steel, from relatively softer aluminum, or from plastic. The operative surface of the removable faceplate 15 that faces the workpiece may be either smooth, patterned with serrations, patterned with a criss-cross grid, or otherwise texturized in order to better provide a nonslip surface to the workpiece.

Figure 4:
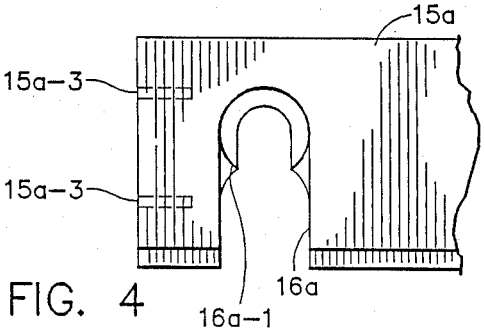
FIG. 4 is a front view showing a keyhole slot within a second embodiment of a removable faceplate of the system in accordance with the present invention.
Figure 5:
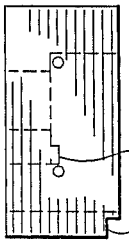
Figure 6:
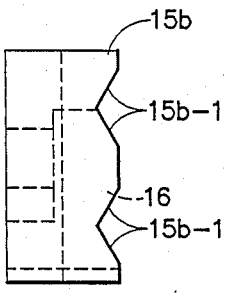
FIG. 6 is an end view of a third embodiment of a removable faceplate of the system in accordance with the present invention.

A second embodiment of a removable faceplate 15 in accordance with the present invention is shown in FIGS. 4 and 5. The type of keyhole aperture present within faceplate **15*a* shown in FIGS. 4 and 5 is a keyhole slot 16*a*. The keyhole slot 16*a* opens to one long side of removable faceplate 15*a*. The operation of the keyhole slot 16*a* to receive and to engage fastener 19 is equivalent to the operation of keyhole aperture 16 shown in FIGS. 1–3. The keyhole slot 16*a* is preferably countersunk equivalently to keyhole aperture 16. Finally, the keyhole slot 16*a* is preferably countersunk to two slightly different depths, as is most clearly illustrated by the metal shoulder 15*a*–2 visible in FIG. 5. The metal shoulder 5*a*–2 helps to maintain the head of fastener 19 in precise alignment to removable faceplate 15*a* equivalently to the function of metal shoulder 15-1 to faceplate 15 (shown in FIGS. 2 and 3**).

The second embodiment of removable faceplate **15*a* presents a lip 15*a*–1 at its lower interior edge. The lip 15*a*–1 is a typical, exemplary, feature that demonstrates how a removable faceplate may be contoured to better contact and grasp a workpiece of complementary configuration. The particular workpiece (not shown) held by removable faceplate 15***a* at the position of its lip 15*a*–1 is typically a planar sheet.

Two threaded bores, illustrated by example as bores 15*a*–3 in removable faceplate 15*a* shown in FIGS. 4 and 5, are an optional feature in each butt end surface of each embodiment of a removable faceplate in accordance with the present invention. The threaded bores 15*a*–3 receive machine bolts, typically of size ¼"–28½", to attach a simple plate (not shown) that serves as a mechanical stop during machining operations. If desired this end plate, or stop, may itself have keyhole apertures and be affixed to the removable faceplates 15, 15*a*, 15*b* by the system in accordance with the present invention. Normally, however, perpendicular stops are infrequently mounted to the vise jaw removable faceplates. Therefore machine bolts are not illustrated in position within bores 15*a*–3, and stop plates are not shown.

Figure 7:
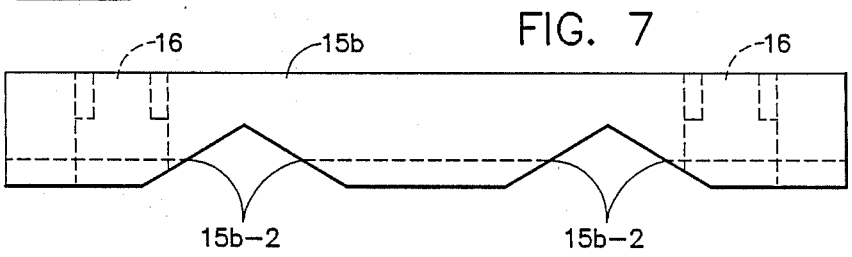
FIG. 7 is a top view of the third embodiment of the removable shown in FIG. 6.

A third embodiment of a removable faceplate 15*b* and its keyhole aperture 16 are shown in FIG. 7. The third embodiment of faceplate 15*b* is distinguished by having both longitudinal V-grooves 15*b*–1 and transverse V-grooves 15*b*–2. The removable faceplate 15*b* is particularly adapted, when situated oppositely to a like faceplate 15*b* mounted upon an opposing jaw, for grasping cylindrical workpieces such as tubing. It may be noted that the keyhole aperture 16 which is machined within this third-type removable faceplate 15*b* is identically configured to the keyhole aperture 16 within removable faceplate 15 shown in FIGS. 1–3. It serves the same purpose in the affixation system in accordance with the present invention.

Figure 8:
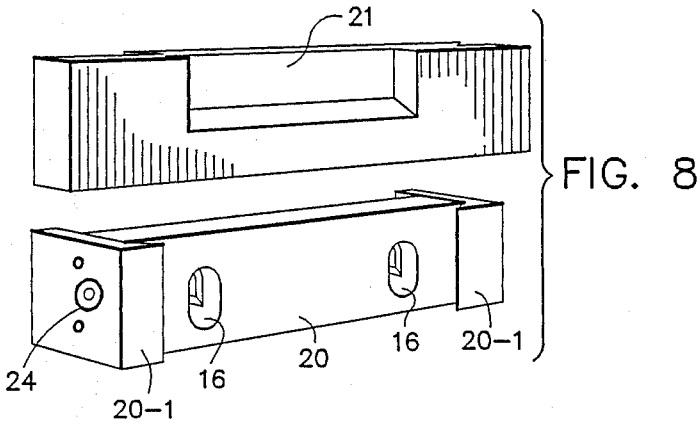
FIG. 8 is an exploded perspective view showing a keyhole-apertured removable mount of the affixation system in accordance with the present invention, which mount itself mounts a removable second faceplate, via interlocking dovetailed grooves and clip plates.
Figure 9:
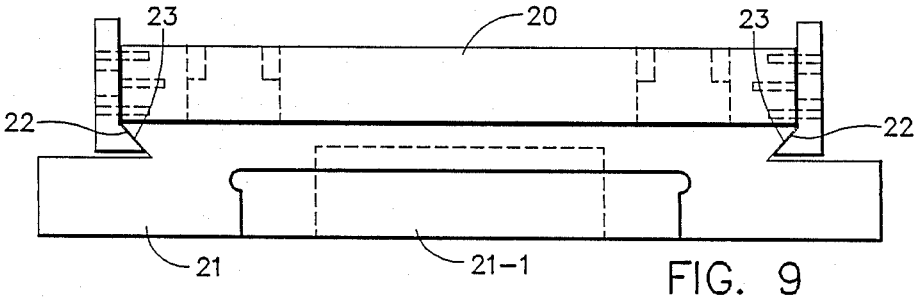
FIG. 9 is a top view showing the removable mount mounting a removable second faceplate.

Still a further, fourth, embodiment of the removable faceplate affixation system in accordance with the present invention is shown in FIGS. 8 and 9. A removable assembly 20, now called a removable mount, defines two keyhole apertures 16. It is affixed to the face surfaces 17, 18 of jaws 13, 14 of vise 10 (shown in FIG. 1) in a like manner as removable faceplate 15 was affixed. The removable mount 20 shown in FIGS. 8 and 9 is, however, not a faceplate which directly contacts the workpiece (not shown). Rather, the removable mount 20 itself mounts a removable faceplate 21.

The faceplate 21 is normally retained at the face of removable mount 20 by complementary interlocking transverse dovetail grooves 22, 23 that are upon both removable mount 20 and upon removable faceplate 21. An allen-headed screw 24 at each end of faceplate 20 tightens moveable end sections, or clip plates, 20-1. The clip plates 20-1 grasp the removable faceplate 21 at the position of its dovetail grooves 23.

The removable faceplate 21 may optionally have a region that is relieved of material, for example the illustrated central region 21-1, in order to form a surface of custom contour for engaging and holding a workpiece.

One teaching of FIGS. 8 and 9 is that the removable faceplate affixation system in accordance with the present invention is still usable to good advantage even when other quick-disconnect faceplate affixation systems, such as those using dovetail grooves and clip plates, are employed. Particularly, the interlocking dovetail grooves and clip plates system for holding a removable faceplate that is shown in FIGS. 8 and 9 does not provide high positional stability or high strength during imposition of longitudinal forces upon the faceplate during machining operations. The allen-headed bolt 24 that secures the clip plates 20-1 to removable mount 20 is the principal means by which removable faceplate 21 is held in position. Conversely, the holding of removable mount 20, and of removable faceplates 15–15*b* shown in FIGS. 1–7, is by the strong fasteners 19 that fit within the keyhole apertures 16. The quick-disconnect faceplate affixation system in accordance with the present invention is not the only possible such system. However, it is a system that tightly mounts a removable faceplate to a vise jaw in good alignment at high strength.

The method in accordance with the present invention for affixing a removable faceplate to the jaw of a vise is straightforward. A fastener that is within the face of the vise's jaw is loosened without separating the fastener from the jaw. A faceplate having a keyhole aperture is then slipped over the fastener so that the keyhole aperture's relatively wider region initially slips a relatively larger head portion of the fastener. The keyhole aperture's relatively narrower region is finally positioned between the vise jaw's face and the fastener's head portion. At this time a relatively smaller shank portion of the fastener passe through the keyhole aperture's relatively narrower region. Finally the fastener is tightened to hold the faceplate against the jaw. The entire procedure is quite fast, typically requiring less than fifteen seconds per removable faceplate. The speed of faceplate substitution is typically fifteen times as fast as prior art methods requiring a complete unscrewing and rescrewing of bolts.

In accordance with the preceding discussion, other obvious alternatives and embodiments of the present invention will be suggested to a practitioner of the mechanical arts. For example, the affixation system of the present invention employing headed fasteners and keyhole aperture is not limited to horizontal vise jaws. It could alternatively be used to affix faceplate to vise jaws that are aligned along any three dimensional axis. By consideration of the various surface contours of faceplates 15, 15*a*, and 15*b*, it will be recognized that the varying face contours of a removable faceplate are not a substantial hindrance to use of the affixation system and method of the present invention. Finally, by consideration the removable mount 20 holding a removable faceplate 21 shown in FIGS. 8 and 9, it will be recognized that the affixation system and method of the present invention may be compatibly employed proximate to, and in conjunction with, other affixation systems.

In accordance with these and other possible variations and adaptations of the present invention, the present invention should be interpreted in accordance with the scope of the following claims, only and not solely in accordance with those embodiments within which the invention has been taught.

What is claimed is:

1. A vise comprising:

a frame;

two opposed jaws, at least one of which is slidable relative to the frame, for selectively grasping a workpiece between opposed faces of the jaws;

a fastener, having a relatively wider head region and a relatively narrower shank, mounted at the face of at least one jaw and protruding therefrom for tightening and loosening to extend relatively closer to, and relatively further from, the jaw's face; and a removable faceplate, defining at least one keyhole aperture, that is removably rigidly affixable by the fastener at the face of the at least one jaw by action of (i) slipping a wide portion of the keyhole aperture over the relatively wider head region of the fastener and then (ii) sliding this relatively wider head region over a relatively narrower region of the keyhole aperture so that the relatively narrower shank of the fastener fits through this relatively narrower region of the keyhole aperture and then (iii) tightening the fastener.

2. The vise according to claim 1 wherein the keyhole aperture defined by the removable faceplate is a hole of closed circumference.

3. The vise according to claim 1 wherein the keyhole aperture defined by the removable faceplate is a slot of open circumference.

4. The vise according to claim 1 wherein the keyhole aperture defined by the removable faceplate is countersunk so that the fastener head region when positioned over the narrower region of the keyhole aperture is at or below the surface of the faceplate.

5. The vise according to claim 1 wherein the fastener comprises:

a headed bolt screwed within a threaded hole that is defined by the face of the at least one jaw.

6. The vise according to claim 1:

wherein the face of the at least one jaw presents two fasteners protruding therefrom; and wherein the removable faceplate defines two keyhole apertures of complementary size and spacing to the two fasteners.

7. The vise according to claim 1 wherein the face of the removable faceplate that contacts the workpiece is of a non-planar contour suitably complementary to the contour of a workpiece in order to better grasp and hold the workpiece.

8. The vise according to claim 7 wherein the removable faceplate's face contour is a V-groove.

9. The vise according to claim 1 wherein the removable faceplate is in the form of a removable mount that itself mounts a removable faceplate.

10. The vise according to claim 9 wherein the removable faceplate is mounted to the removable mount faceplate by interlocking dovetail grooves.

11. The vise according to claim 1 wherein the removable faceplate defines one or more threaded bores in at least one of its butt ends.

12. A system for affixing a removable faceplate to the jaw of a vise comprising:

a tightenable fastener mounted within the face of the vise's jaw and protruding therefrom, the fastener having a relatively larger diameter head region and a relatively smaller diameter shank region, the fastener being tightenable so as to draw its head region towards the jaw's face;

a removable faceplate defining a keyhole aperture with a relatively larger diameter portion capable of slipping the fastener's head region and with a relatively smaller diameter portion capable of slipping the fastener's shank but incapable of slipping the fastener's head;

wherein the faceplate is removably rigidly affixable by the fastener at the face of the vise's jaw by action of (i) slipping a wide portion of the keyhole aperture over the relatively wider head region of the fastener and then (ii) sliding this relatively wider head region over a relatively narrower region of the keyhole aperture so that the relatively narrow shank of the fastener fits through this relatively narrower region of the keyhole aperture and then (iii) tightening the fastener.

13. The system according to claim 12 wherein the fastener comprises:

a bolt screwed within the face of the vise's jaw.

14. A vise comprising:

a frame;

two opposed jaws, at least one of which is slidable relative to the frame, for selectively grasping a workpiece between opposed faces of the jaws;

a fastener, having a relatively wider head region and a relatively narrower shank, mounted at the face of at least one jaw and protruding therefrom; and a removable faceplate, defining at least one keyhole aperture countersunk to two different depths so that the fastener head region when positioned over the narrower region of the keyhole aperture is at or below the surface of the faceplate and so that a shoulder of metal surrounds the fastener head region therein promoting precision alignment between the fastener mounted at the face of at least one jaw and the removable faceplate, that is removably affixable by the fastener at the face of the at least one jaw by action of (i) slipping a wide portion of the keyhole aperture over the relatively wider head region of the fastener and then (ii) sliding this relatively wider head region over a relatively narrower region of the keyhole aperture so that the relatively narrower shank of the fastener fits through this relatively narrower region of the keyhole aperture and then (iii) tightening the faceplate against the fastener head.

15. A removable faceplate for a vise's jaw presenting a tightenable headed fastener protruding from the face of the jaw, the removable faceplate comprising:

a plate member faceable against the vise's jaw to substantially cover the area and shape thereof, the plate member having and defining a keyhole aperture that is countersunk in its narrow region below an exposed surface of the plate member that is opposite its facing surface, the plate member's keyhole aperture being interactive with the vise jaw's tightenable headed fastener so that the plate member is removably rigidly affixable by the fastener at the face of the vise's jaw by action of (i) slipping a wide portion of the keyhole aperture over the relatively wider head region of the fastener and then (ii) sliding this relatively wider head region over a relatively narrower region of the keyhole aperture so that the relatively narrower shank of the fastener fits through this relatively narrower region of the keyhole aperture and then (iii) tightening the fastener so that its head region is recessed in the countersunk region of the keyhole aperture below the exposed surface of the plate member.

* * * * *